United States Patent [19]

Meinel et al.

[11] Patent Number: 5,067,146

[45] Date of Patent: Nov. 19, 1991

[54] X-RAY RADIATOR

[75] Inventors: Fred Meinel, Eckental; Dorothea Wilke, Erlangen, both of Fed. Rep. of Germany

[73] Assignee: Siemens Aktiengesellschaft, Munich, Fed. Rep. of Germany

[21] Appl. No.: 606,919

[22] Filed: Oct. 31, 1990

[30] Foreign Application Priority Data

Nov. 9, 1989 [EP] European Pat. Off. ..... 89120807

[51] Int. Cl.[5] ..... H01J 35/10

[52] U.S. Cl. ..... 378/199; 378/202

[58] Field of Search ..... 378/199, 200, 201, 202

[56] References Cited

U.S. PATENT DOCUMENTS

| | | | |
|---|---|---|---|
| 1,941,270 | 12/1933 | Pieper | 378/201 |
| 2,036,096 | 3/1936 | Pieper . | |
| 2,194,369 | 3/1940 | Simon . | |
| 2,320,559 | 6/1943 | Bouwers . | |
| 2,592,496 | 4/1952 | Vigh . | |
| 4,546,489 | 10/1985 | Kuhnke et al. . | |

*Primary Examiner*—Craig E. Church

*Attorney, Agent, or Firm*—Hill, Van Santen, Steadman & Simpson

[57] ABSTRACT

An x-ray radiator has an x-ray tube disposed in a coolant-filled housing formed by a tank and an insertable closure for the tank. The x-ray tube is held in a tube carrier, which is mounted to the insertable closure so that the position of the tube carrier, and thus of the x-ray tube, can be adjusted relative to the insertable closure.

4 Claims, 2 Drawing Sheets

X-RAY RADIATOR

BACKGROUND OF THE INVENTION

1. Field of the Invention

The present invention is directed to an x-ray radiator of the type having an x-ray tube contained in a housing filled with coolant, the housing being formed by a tank and an insertable closure. X-ray radiators of this type are suited for use as single-tank x-ray diagnostic generators, and contain all of the components needed to generate the x-rays.

2. Description of the Prior Art

An example of a single tank x-ray radiator is disclosed in German utility model application 81 32 991, corresponding to U.S. Pat. No. 4,546,489. In this known x-ray radiator, the x-ray tube is disposed in the proximity of a radiation exit window located in an insertable closure for a single oil-filled container or tank. Two high voltage transformers are symmetrically attached to the insertable closure next to the x-ray tube. Filament transformers for the foci of the x-ray tube are disclosed at one end of the x-ray tube. Rectifiers and high voltage capacitors are disposed symmetrically relative to the radiation exit window at the side of the x-ray tube facing away from the radiation exit side.

The insertable closure and the tank are welded to each other to provide an oil-tight enclosure. A problem in this known structure is that alignment of the x-ray tube with the radiation exit window, and for adjusting the radiation direction, cannot be undertaken under operating conditions after the housing has been closed.

SUMMARY OF THE INVENTION

It is an object of the present invention to provide a single tank x-ray radiator of the type wherein an oil-filled housing for the radiator components is formed by a tank and an insertable closure, and wherein the x-ray tube carrier is attached to the insertable closure, wherein the position of the x-ray tube can be adjusted from outside of the housing without opening the housing, so that the x-ray tube can be adjusted during operation and after closure of the housing.

The above object is achieved in accordance with the principle of the present invention in an x-ray radiator wherein the tube carrier is mounted on the insertable closure by retaining means having a portion thereof which is accessible at a side of the insertable closure which forms a part of the exterior of the housing, after the housing is closed. Adjustment of the position of the tube carrier, and thus of the x-ray tube, can thus be undertaken from outside of the housing via this accessible portion.

In a preferred embodiment, the adjustable retaining means consists of screws rotatably secured to the insertable closure, which engage threads in the tube carrier. The screws can rotate within the insertable closure, but are prevented from being axially withdrawn from the insertable closure, so that when the screws rotate within the threads of the tube carrier, the tube carrier will be displaced a selected distance from the insertable closure. A plurality of such screws are used to mount the tube carrier to the insertable closure. By rotating all of the screws by the same amount, the tube carrier will be displaced parallel to the insertable closure, however, it is also possible to rotate different screws by different amounts so that the tube carrier, and thus the x-ray tube, can be canted relative to the insertable closure, as may be needed to adjust the position of the x-ray tube, and thus the x-ray beam, relative to the radiation exit window in the insertable closure. Three dimensional adjustment of the x-ray beam can thus be undertaken.

Preferably each screw has a threaded portion which engages a correspondingly threaded bore in the tube carrier, and a thickened portion which engages a bore either in, or attached to, the insertable closure, and is supported against the insertable closure. At the end of each screw opposite the end which engages the tube carrier, the screw is provided with another set of threads, which engage a lock nut seated against the insertable closure. The housing can thus be maintained oil-tight by providing a bushing extending through the insertion head with a seal.

DESCRITPION OF THE DRAWINGS

DESCRIPTION OF THE PREFERRED EMBODIMENTS

Figure 1:
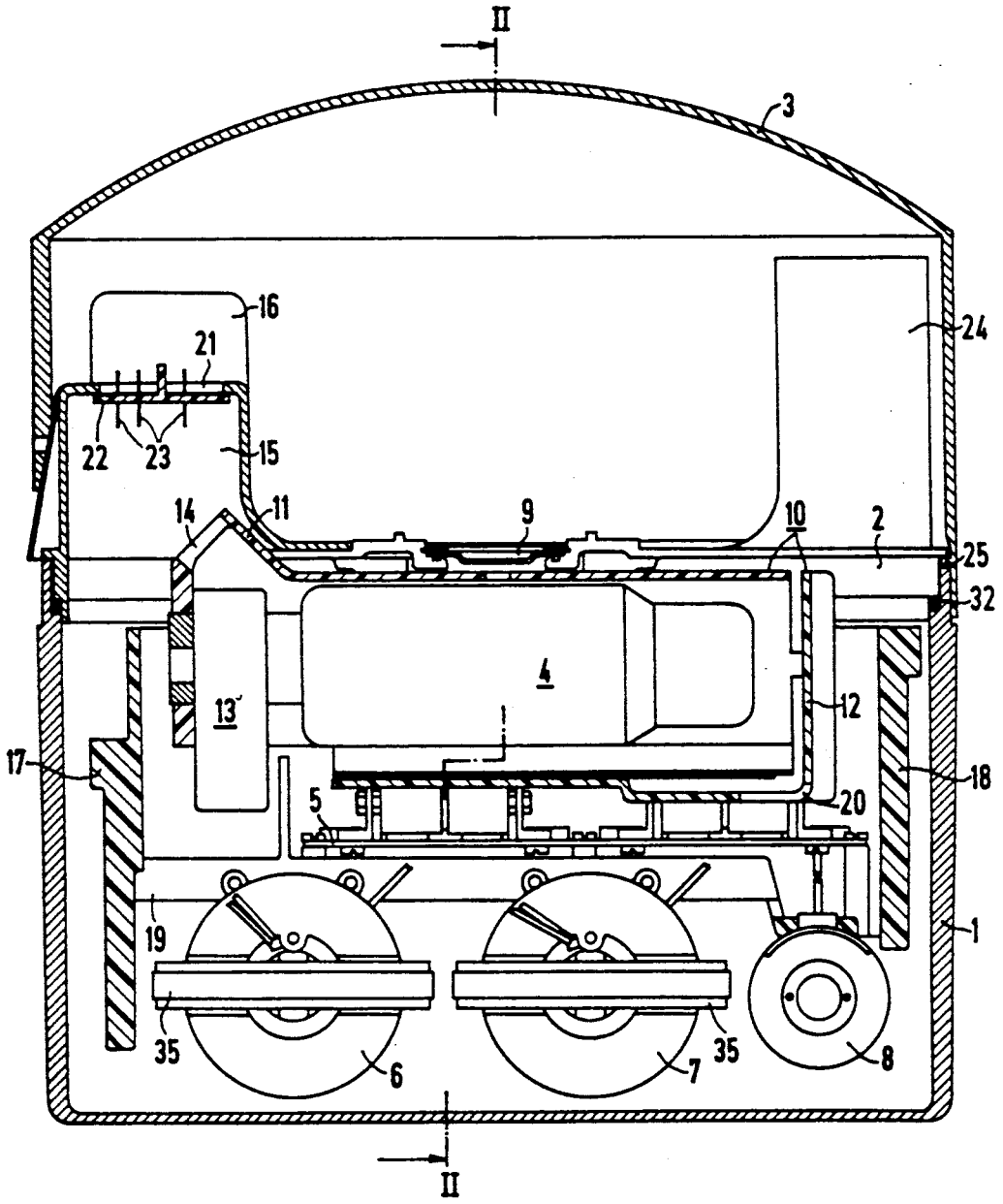
FIG. 1 is a side sectional view of an x-ray radiator constructed in accordance with the principles of the present invention.

An x-ray radiator constructed in accordance with the principles of the present invention as shown in FIG. 1 having an oil-filled housing consisting of a tank 1 and an insertable closure 2. A hood 3 covers the insertable closure 2. An x-ray tube 4, a base plate 5 having rectifiers and two high voltage transformers 6 and 7, and a filament transformer 8, are contained in the oil-filled housing.

A radiation beam exit window is disposed centrally in the insertable closure 2. A tube carrier 10, consisting of two pieces, for the x-ray tube 4 is attached to the insertable closure 2, by retaining elements 26, 27 and 28 shown in FIG. 2. One end of the x-ray tube 4 is attached to an upper part 11 of the tube carrier 10, with an asymmetrical cooling member 13 being attached to that end. The upper part 11 of the tube carrier 10 is provided with an opening 14 in the region of the cooling member 13. The tube carrier 10 is outwardly bent around the opening 14, so that the opening 14 projects into a heat exchanger 15. The heat exchanger 15 is formed by a projection of the insertable closure 2. The heat exchanger 15 is provided with cooling ribs 16.

A lower part 12 of the tube carrier 10 surrounds only the x-ray tube 4, and not the cooling member 13, so that the cooling member 13 becomes heated during operation of the x-ray tube 4 and, by convection, causes a flow of the coolant in the upward direction (given the orientation of the radiator as shown in FIG. 1). The coolant thus proceeds directly into the heat exchanger 15, and is cooled therein. Upon becoming cooled, due to the force of gravity the cooled oil descends, and is then available to receive further heat from the cooling member 13. This gravity-induced coolant circulation is conducted through a guide partition 17, which forms a part of a component carrier 19. Due to the asymmetrical cooling member 13, which is heated by thermal conduction independently of the force of gravity, the lower portion of the coolant oil is heated, and thus coolant circulation is promoted.

The lower portion 12 of the tube carrier 10 also has an opening 20 in the region of the end of the x-ray tube 4 which faces away from the cooling member 13. A gap is left between the two parts 11 and 12, so that the coolant can pass therebetween. The components carrier 19 has a perpendicularly arranged partition 18 in this region, which promotes heat circulation in that region.

Figure 2:
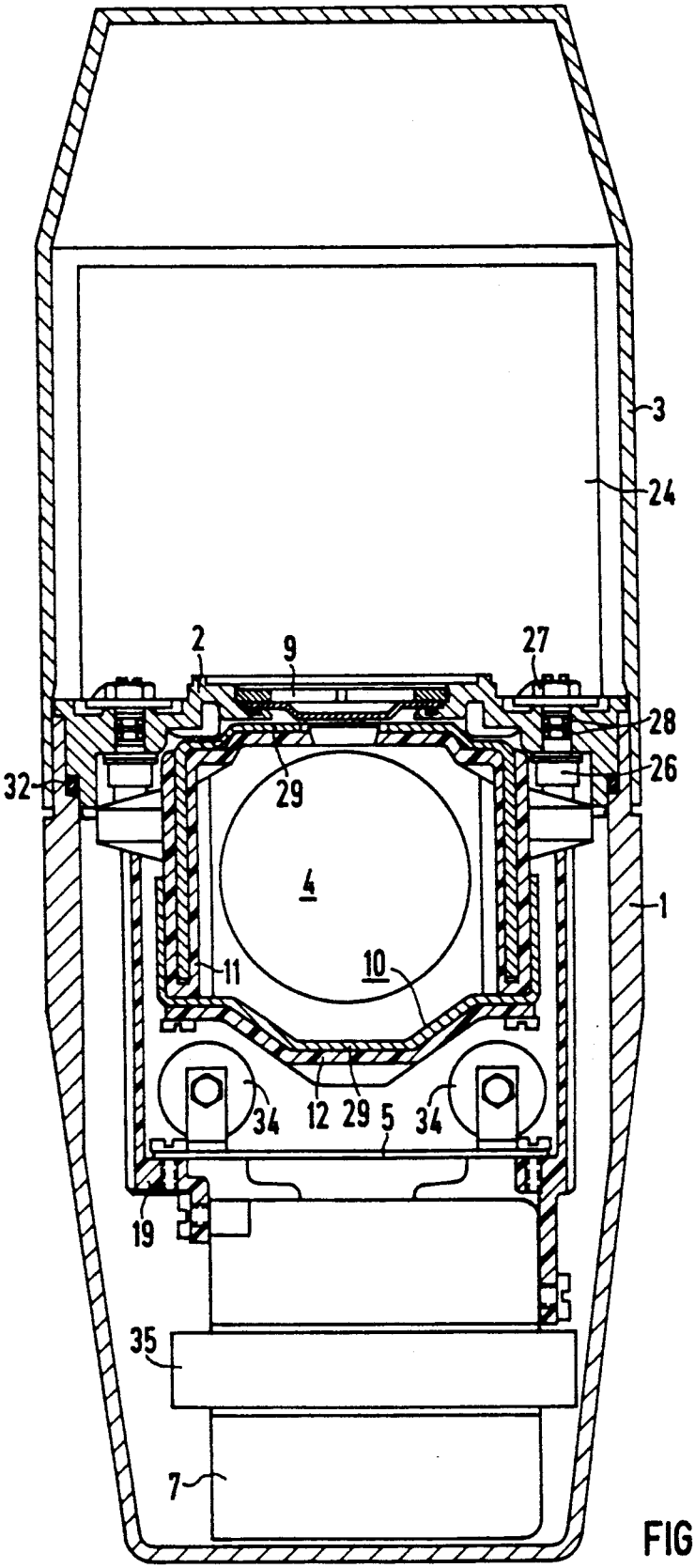
FIG. 2 is a sectional view taken along line II—II of FIG. 1.

As can be seen in FIG. 2, the tube carrier 10 has a rectangular cross-section, so that as much oil as possible can pass through the tube carrier 10 to cool the x-ray tube 4. Due to the electrical field which is generated during operation of the x-ray tube, a second coolant flow in the longitudinal direction of the x-ray tube 4 and of the tube carrier 10 arises. Cooling of the x-ray tube 4 thus ensues not only via the cooling member 13, but also via the tube bulb. A circulation and exchange of coolant is also achieved, so that the coolant which is heated at the end of the x-ray tube away from the cooling member 13 can also proceed to the heat exchanger 15.

The printed circuit board 5 on which the high voltage capacitors 34 shown in FIG. 2 and the rectifiers (not shown) are arranged is attached to the components carrier 19 at that side of the tube carrier 10 facing away from the insertable closure 2. The high voltage transformer 6 and 7 and the filament transformer 8 are arranged beneath the printed circuit board 5. In order that the high voltage transformer 6 and 7 will operate relative loss-free and will generate only low heat, their cores 35 may consist of amorphous metal such as, for example, Vitrovac®.

For the external connection of electrical leads, the heat exchanger 15 is provided with an opening 21 closed by a plate 22. The external connections are achieved by contact pins 23 conducted through the plate 22. The plate 22, and the printed circuit board 5, may be produced using SIL technology. In this type of fabrication a preform of plastic is produced which is subsequently coated with a layer of conductive material, which forms the solder contacts and interconnects. This structure achieves a contact lead-through which is oil-tight.

The insertable closure of the x-ray radiator may also be provided with a projection 24, at the side thereof opposite the heat exchanger 15, which can accept a pressure equalization membrane.

The tank 1 and the insertable closure 2 are covered by the hood 3 which laterally overlaps the tank 1. For retention, the hood 3, at a narrow side thereof, is provided with a detente 25 which engages a groove. The groove can be provided either in a side of the tank 1 or, as shown in FIG. 1, can be formed between the edge of the tank 1 and the insertable closure 2. At its opposite narrow side, the hood 3 overlaps the heat exchanger 15, and is connected thereto by screw 36, shown in FIG. 3.

At the side of the tank which the heat exchanger 15 is located, the tank 1 and the hood 3 have recessed and, as shown in FIG. 3, seating surfaces 37 for a bracket for holding the x-ray radiator, for example a C-arm. Since the surfaces 37 are also in thermal communication with the heat exchanger 15, additional heat elimination from the heat exchanger 15 can occur via the bracket.

A section through the x-ray radiator of FIG. 1 along line II—II is shown in FIG. 2. It can be seen in FIG. 2 that the tube carrier 10 is connected to the insertable closure 2 by adjustable retainer elements 26, 27 and 28. The retainer elements include screws having a threaded portion engaging a threaded bore in the tube carrier 10. The screws are supported at the insertable closure by projections. The other side of each screw receives a lock nut 17. Sealing rings 28 are provided so that the bores for the screws are maintained oil-tight. By adjusting the screws of the retainer elements, the position of the tube carrier 10 and thus of the x-ray tube 4, can be adjusted relative to the insertable closure 2, because the retainer elements are rigidly connected to the insertable closure 2. The x-ray tube 4 can thus be maintained parallel to the insertable closure 2, but the distance therebetween can be adjusted, or the x-ray tube 4 can be tilted to the anode side or to the cathode side, or can be rotated around its longitudinal axis.

The tube carrier 10 may consist, for example, of plastic. For reducing radiation leakage, the carrier 10 can be provided with lead plates 29 which, for example, may engage slots in the tube carrier 10 and may be held by those slots.

A seal ring 32, which may be a rubber O-ring preshaped so as to match the rectangular shape of the x-ray radiator, is pressed between mating stepped edges of the insertable closure 2 and the tank 1. Only a slight deformation of the O-ring 32 will therefore occur at its edge regions, so that there will be substantially no constriction of the O-ring 32. Other securing means, such as laterally extending screws (not shown), can be provided to hold the insertable closure 2 and the tank 1 tightly together.

As described above, the height of the x-ray tube 4 and the tube carrier 10 relative to the insertable closure 2 can be adjusted by the screws 26 received in the tube carrier 10, so that the width of the x-ray beam can be set. Four such screws 26 may be used. By adjusting two of the screws 26, the position of the x-ray tube can be adjusted along its longitudinal axis, or at a right angle thereto. If the carrier 10 is manufactured of plastic, the carrier 10 can be twisted by adjusting only one screw 26, so that diagonal adjustments of the x-ray tube are also possible.

By virtue of the structure disclosed herein, the x-ray tube 4 can be adjusted after the x-ray radiator is completely assembled, so that the assembly steps are simplified.

Although modifications and changes may be suggested by those skilled in the art, it is the intention of the inventors to embody within the patent warranted hereon all changes and modifications as reasonably and properly come within the scope of their contribution to the art.

We claim as our invention:

1. In an x-ray radiator having a tank and an insertable closure forming a housing filled with coolant, and an x-ray tube having a longitudinal axis disposed in said housing, the improvement comprising:

a tube carrier which holds said x-ray tube in said housing; and retaining means for mounting said tube carrier to said housing, said retaining means having a portion thereof accessible at an exterior of said housing for adjusting the position of said tube carrier and said x-ray tube by displacing said longitudinal axis of said x-ray tube relative to said housing.

2. The improvement of claim 1 wherein said retaining means consists of a plurality of screws rotatably held in said insertable closure, and a plurality of threaded bores in said tube carrier respectively engaging said screws.

3. The improvement of claim 2 wherein each screw has a first threaded portion engaging one of said threaded bores in said tube carrier, a thickened portion engaging a bore in said insertable closure and supported against said insertable closure, and a second threaded portion which receives a lock nut supported against the exterior of said insertable closure.

4. The improvement of claim 3 wherein each bore in said insertable closure has a seal for preventing leakage of said coolant therethrough.

* * * * *